US006427661B1

(12) United States Patent
Spannbauer

(10) Patent No.: US 6,427,661 B1
(45) Date of Patent: Aug. 6, 2002

(54) DUCT SYSTEM WITH THROTTLE VALVE

(75) Inventor: Helmut Spannbauer, Moeglingen (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/598,045

(22) Filed: Jun. 21, 2000

(30) Foreign Application Priority Data

Jun. 21, 1999 (DE) ..... 199 28 354

(51) Int. Cl.[7] ..... F02D 9/08
(52) U.S. Cl. ..... 123/337; 251/305
(58) Field of Search ..... 123/337; 48/144; 180/170, 178; 251/305

(56) References Cited

U.S. PATENT DOCUMENTS 4,378,000 A * 3/1983 Moriya et al. ..... 123/442
4,572,478 A * 2/1986 Vogler et al. ..... 251/305
4,759,326 A * 7/1988 Uthoff, Jr. et al. ..... 123/337
4,809,659 A * 3/1989 Tamaki et al. ..... 123/399
5,752,484 A * 5/1998 Apel et al. ..... 123/396
6,076,499 A * 6/2000 Klumpp ..... 123/337
6,164,623 A * 12/2000 Ito et al. ..... 251/305
6,182,628 B1 * 2/2001 Kochs et al. ..... 123/184.21
6,189,506 B1 * 2/2001 Yanderveen ..... 123/337

* cited by examiner

*Primary Examiner*—Willis R. Wolfe
*Assistant Examiner*—Arnold Castro
(74) *Attorney, Agent, or Firm*—Crowell & Moring LLP

(57) ABSTRACT

A duct system with a throttle valve, particularly useful as an air intake duct for an internal combustion engine, in which the throttle valve is configured in such a way that in the closed position it covers only a partial region of the cross-sectional area of the duct which is to be throttled and leaves another partial region open so that air can continue to flow through the intake duct. This condition is suitable, particularly at low engine rotational speeds, to dampen the air intake noise of the internal combustion engine. When the throttle valve is positioned perpendicular to the direction of air flow through the duct, sound waves in the air intake duct of the internal combustion engine are reflected back toward the engine, and in this way an economical possibility for influencing the air intake noise results which also can be utilized to design a desired noise profile for the engine.

9 Claims, 2 Drawing Sheets

DUCT SYSTEM WITH THROTTLE VALVE

BACKGROUND OF THE INVENTION

The invention relates to a duct system with a throttle valve, especially an air intake duct of an internal combustion engine in which a throttle valve is arranged pivotably in a cross section of the duct. Furthermore, the invention relates to a throttle valve for installation in such a duct system. The invention also relates to a process for controlling a throttle valve in an air intake duct of an internal combustion engine.

It is generally known use throttle valves to close and to open the cross-section of an air intake duct for combustion air for an internal combustion engine. Furthermore, these throttle valves can also be utilized in a partially opened state. This use offers the advantage of reducing the air intake noise in operating ranges of the motor in which the complete cross-section of the air intake duct is not needed to provide combustion air. This occurs through partial closure of the throttle valve. In this way, the cross-sectional area of the flow channel on the raw air side is maintained as small as possible while matched to the operating condition. At the full power operating point, the supply of air to the motor is assured by complete opening of the cross-section of the duct. The remaining cross-sectional area between the wall of the duct and the throttle valve can be adjusted, for example, proportionally to the required mass flow. This achieves in a first approximation the same average rate of flow in the vicinity of the throttle valve.

The continuous adjustment of the throttle valve, however, raises problems. When small cross-sectional areas are required, narrow gaps result between the wall of the duct and the throttle valve which can lead to unfavorable flow conditions. Particularly, if the throttle valve and the cross-section of the duct have a round configuration, a whistling noise, which is more unpleasant than the intake 10 air noise that is to be avoided, can arise through the resulting sickle-shaped gap.

One possibility for solving this problem is proposed in European patent EP 889 228. According to this proposal the intake duct of the internal combustion engine has two partial cross sections which are separated from each other by an intermediate wall. The throttle valve is disposed in only one of the partial cross-sections, so that at low rotational speeds (rpm) of the motor, the one partial cross-sectional area of the intake duct can be closed. In this way a reduction of the air intake noise can be achieved.

The multi-chamber profile of the described air intake arrangement, however, causes additional expense. A higher expenditure for materials results, which also leads to an increase in the overall weight of the air intake system and makes the manufacturing process more difficult. For these reasons the proposed solution is less economical, and therefore its use is precluded at the least in modestly priced variants of motor vehicle lines.

SUMMARY OF THE INVENTION

It is the object of the invention therefore, to provide a device for decreasing the cross-section of a duct system which is reliable in operation and inexpensive to manufacture and which exhibits favorable acoustic characteristics.

These and other objects of the invention are achieved by the throttle apparatus and by the process for controlling a throttle valve which are described and claimed hereinafter.

The duct system of the invention includes a throttle valve which is pivotably arranged in a cross section of the duct system. The duct system conducts a fluid which is to be throttled. In accordance with the invention, however, the throttle valve is dimensioned such that in the closed position it leaves a residual cross-sectional area open. The term "closed position" refers to that position of the throttle valve in which it covers or closes off the maximum surface of the cross-sectional area which is to be throttled. If the throttle valve has a flat construction, then the closed position is achieved when the surface of the throttle valve is positioned perpendicular to the direction of flow of the fluid stream through the duct.

In contrast to conventional throttle valves, however, in this closed position the residual cross-section remains open and available for passage of fluid. If the throttle valve is utilized in the intake region of the air intake duct of an internal combustion engine, then a complete closure of the air intake cross section is not desired. Therefore, the throttle valve can be dimensioned such that in the closed position it does not completely cover the cross-section of the air intake duct. The perpendicular orientation of the valve is of great advantage from an acoustic point of view. In this way it is possible to for the throttle valve to reflect the sound waves which pass from the internal combustion engine through the air intake duct to the mouth of the air intake. This leads to a reduction in the air intake noise, since the sound waves cannot leave the system through the air intake opening. The reflected sound waves are superimposed over incoming ones, which may lead to a partial or complete cancellation or suppression.

In this way the air intake noise of the internal combustion engine can be decreased, primarily in the lower and medium rotational speed ranges. At the same time, whistling noises, like those which arise with conventional throttle valves when they are closed up to a tiny remaining gap, are prevented. In order to prevent the whistling noises, the residual cross section is advantageously designed to have an annular configuration around the throttle valve. It is not necessary thereby for the throttle valve to have a round configuration. An oval or a rectangular configuration is just as possible, wherein the cross-section of the duct system must match the form of the valve flap.

The throttle valve can be driven by various types of actuators. Candidates include, for example, electrical step motors or continuously adjustable vacuum boxes. A stepped adjustment of the throttle valve is also possible. Even an embodiment with only two steps, i.e. a closed throttle valve and an open throttle valve, which can be economically controlled with a vacuum box, will result in the acoustic advantages described above. However, then the acoustics of the intake duct cannot be continuously adapted to the operating conditions of the internal combustion engine. Instead, operating ranges must be defined in which the different step positions of the throttle valve are used.

In accordance with one particularly advantageous embodiment of the invention, the throttle valve is arranged in the narrowest cross-section of a duct section having a venturi-form cross-sectional configuration. The venturi-form configuration of the duct likewise has an advantageous effect on the acoustics of the intake duct.

It is not necessary for the throttle valve to be round. Instead it can take different forms, for example rectangular. The cross-section of the associated duct section must be appropriately matched to the form of the valve flap. Accordingly, the residual cross-sectional area surrounding the throttle valve and bounded by the walls of the duct system also does not have to be round. Instead, the annular residual cross-section is matched to the contours of the valve flap and the duct. The important thing in the configuration of the residual cross-sectional area is merely that regardless of the position of the valve flap, no regions are produced in which the spacing between the edge of the valve flap and the wall of the duct system is so small that whistling noises can arise.

The acoustic effects described above can be utilized especially efficiently if the residual cross-section amounts to a surface portion equal to from 10 to 40 percent of the overall surface area of the cross-section in which the throttle valve is positioned. In this way, on the one hand, a sufficiently large cross-section is available for operating conditions of the motor which require a maximum amount of air, and on the other hand, the cross-sectional area can be effectively decreased by the throttle valve.

A throttle valve, which when installed in the duct system described above leads to optimal results with regard to the acoustics of the duct system, has the advantages according to the invention. This means that the air flow noises of the fluid being conducted are minimized and sound waves in the interior of the duct system are suppressed.

In order to achieve favorable air intake acoustics throughout the entire rotational speed range of the internal combustion engine when the throttle valve is utilized in the air intake duct of an internal combustion engine, a control process is utilized in which the position of the valve flap is adjusted depending on the amount of combustion air required by the internal combustion engine. Various parameters can thereby be utilized as measured control values. A simple and economical solution results when the rotational speed n of the internal combustion engine is utilized as an adjusting parameter for the angle a of the valve flap. In most operating conditions of the motor, the rotational speed of the engine is proportional to its air requirements. At low rotational speeds, then, the throttle valve can be closed more and more until it reaches its closed position. In the upper rotational speed range the throttle valve is completely opened so that only the projection of the edge of the flap decreases the cross-sectional area of the air intake duct.

In every case, the process for controlling the throttle valve must assure that the internal combustion engine is provided with the minimally required amount of air in every operating state. It may, however, also be advantageous in certain operating states, not to limit the air to the necessary minimum, but instead to make a larger cross-sectional area available. This has the consequence that the air intake noise is greater than the minimum value which can be achieved. This is useful, for example, in the acceleration phase of the motor to give the driver an acoustical feedback from the internal combustion engine. In this way the driver can better recognize the appropriate time points for shifting gears. However, if the motor is operated at a constant rotational speed (rpm) for a longer period of time, then it is desirable to have the lowest possible air intake noise.

An appropriate control of the throttle valve can be achieved if the acceleration of the motor is additionally detected as a signal. In conjunction with this, a detection of the vacuum prevailing in the intake duct can be used as a supplemental control parameter by means of which an insufficient supply of combustion air to the internal combustion engine can be prevented in any event.

These and other features of preferred embodiments of the invention, in addition to being set forth in the claims, are also disclosed in the specification and/or the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DESCRIPTION OF PREFERRED EMBODIMENTS

Figure 1:
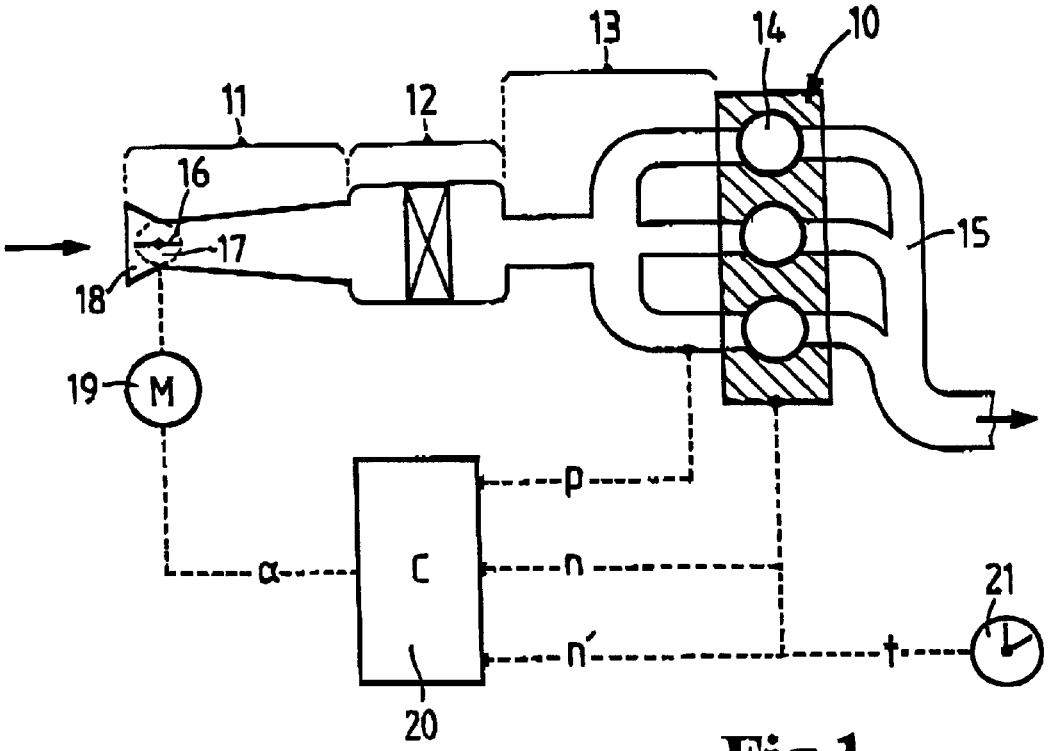
FIG. 1 shows a schematic diagram of an air intake duct with a throttle valve and its controls.

In FIG. 1 the intake duct of an internal combustion engine 10 is schematically illustrated. This is comprised of an intake nozzle 11 having the form of a venturi tube, an air filter 12, an intake duct 13, which leads to individual cylinders 14, from which an exhaust duct 15 carrier away burned gases.

A throttle valve 16 is disposed in the narrowest cross-section 17 of the venturi tube. The throttle valve 16 in FIG. 1 is shown in the completely opened position. Air flows toward the throttle valve from an inlet 18 of the intake nozzle, as indicated by an arrow.

The angular position $\alpha$ of the throttle valve is adjusted by a step motor 19. The adjustment is carried out by means of a control unit 20, which evaluates various adjustment parameters of the air intake duct in order to determine the desired throttle valve position. On the one hand, the prevailing vacuum p in the intake duct can be measured. Furthermore, the rotational speed n of the internal combustion engine can be determined. The rotational speed signal can furthermore be utilized with the assistance of a time clock 21, which provides a time signal t, to determine the acceleration n'.

Figure 2:
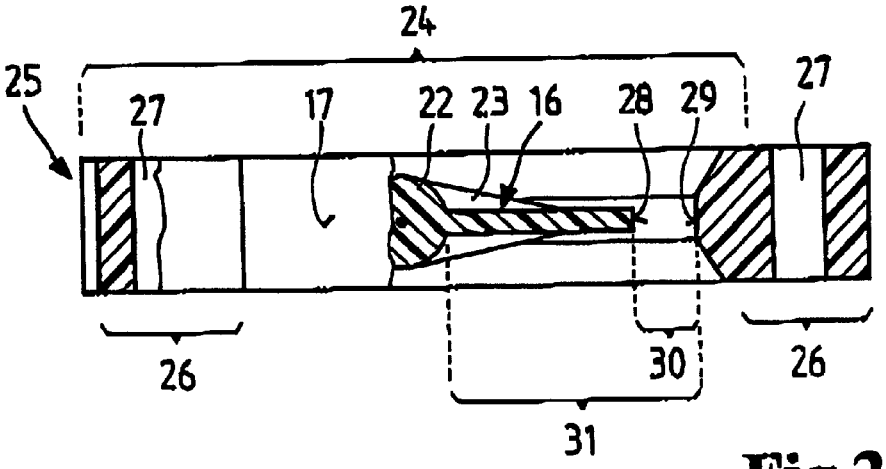
FIG. 2 shows a partial cross-section through a throttle valve element produced by assembly injection-molding with attachment flanges illustrated partially in section.

FIG. 2 shows an example of the construction of a throttle valve according to the invention. The throttle valve is manufactured in one piece with a valve shaft 22 and reinforcing ribs 23. This unit is assembly injection molded in a valve frame 24 so that a throttle valve module 25 is produced.

This module can be installed as a standard component in various duct systems, for which purpose three attachment flanges 26 with receiving apertures 27 for screws are formed on its periphery.

The throttle valve is illustrated in the closed position. Between an edge 28 of the valve flap and an inner wall 29 of the valve frame 24 a residual cross section 30 is formed through which the fluid (e.g., air) can flow. The valve can be continuously opened, whereby a cross-sectional area bounded by the projection of the flap edges onto the cross-section 17 and by the inner margin of the residual cross-sectional area opens further and further. The maximum open cross-section 31 when the valve is completely opened is shown in FIG. 2, whereby in this case the margin of the open cross-section is formed by the valve shaft 22. In every position of the valve, the cross-section through which the fluid can effectively flow is equal to the sum of the residual cross-section and the open cross-section.

Figure 3:
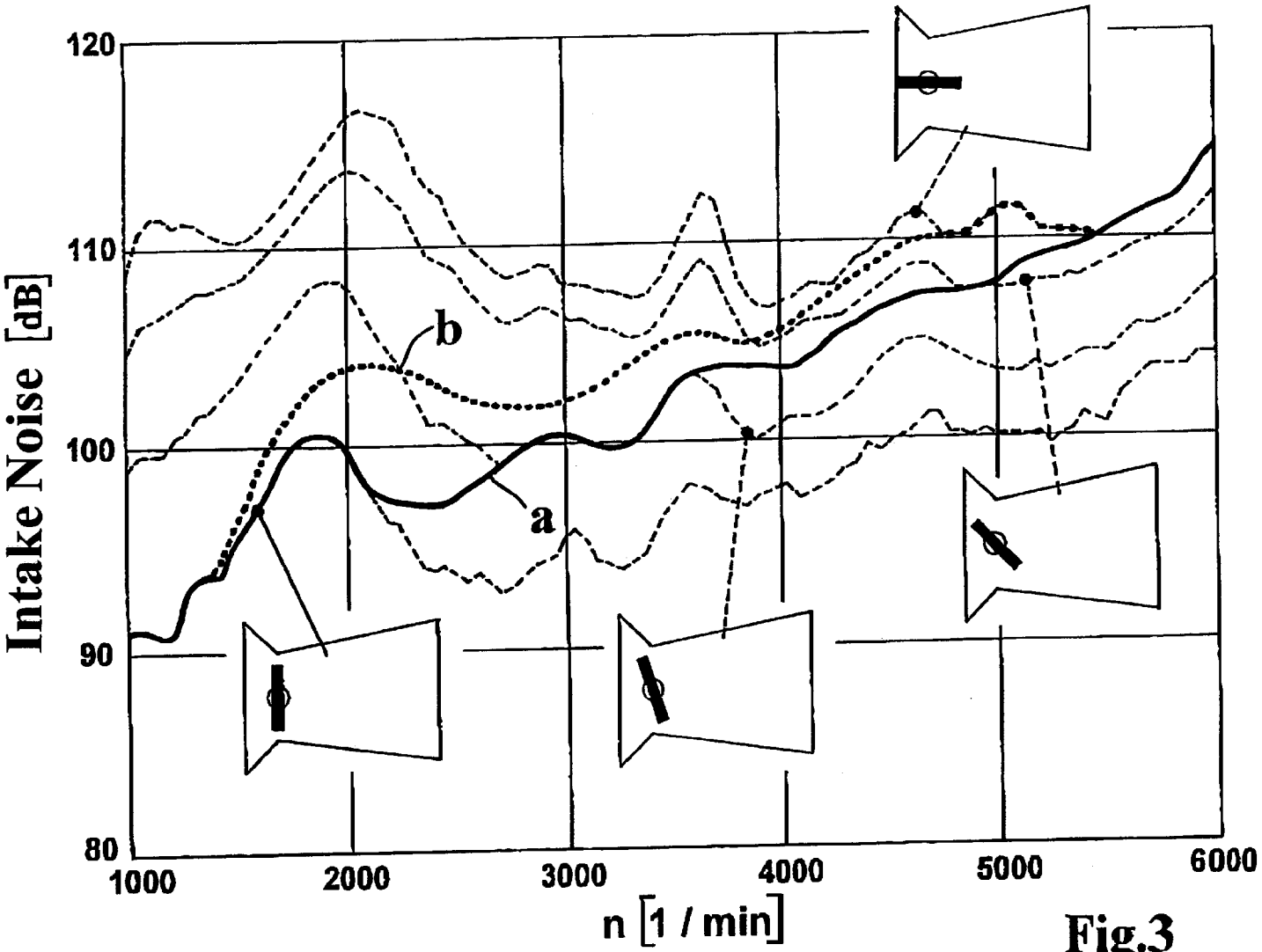
FIG. 3 shows the noise level of the air intake noise depending on the rotational speed of the internal combustion engine at various throttle valve positions.

The effect of the adjustment of the throttle valve is illustrated in FIG. 3. In this example the position of the throttle valve is adjusted depending on the rotational speed n of an internal combustion engine. The completely closed throttle valve covers 81% of the cross-sectional area of the intake duct. The curves shown in broken lines indicate the air intake noise at various throttle valve positions. It is apparent that by progressively closing the throttle valve up to the residual cross-section, the air intake noise can be decreased by up to 18 dB.

If the throttle valve is closed when the motor is in higher rotational speed ranges, however, the motor may not be provided with a sufficient amount of combustion air. Therefore, the throttle valve must be continually opened further and further as the rotational speed of the engine increases. This produces the resulting curve of the intake noise a, wherein in accordance with this curve the throttle valve is adjusted in such a way that the internal combustion engine is always provided with the minimum required amount of air.

To increase the air intake noise in the acceleration phase, however, the throttle valve can be opened more rapidly than necessary to provide the minimum amount of air. Through this measure, the air intake noise of the internal combustion engine increases in these regions and this way makes possible an acoustic feedback for the driver. This manner of operation is illustrated by the curve b.

To generate the curve b, the throttle valve is adjusted discontinuously in relationship to the rotational speed of the engine. In this way the air intake noise can be influenced as desired, by means of which it is also possible to fulfill customer requests for a particular sound profile design.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. A duct system for conducting a fluid flow which is to be throttled, said duct system comprising a duct with a cross-section having a throttle valve pivotally arranged therein to pivot between a closed position and a fully open position, wherein the throttle valve in the closed position blocks only a portion of the duct cross-section and leaves open a residual portion of the duct cross-section through which the fluid which is to be throttled can continue to flow, said residual portion of the duct cross-section annularly surrounding the throttle valve and having a cross-sectional area which amounts to between 10 and 40% of the overall cross-sectional area of the duct cross-section.

2. A duct system according to claim 1, wherein the duct system is an air intake duct for an internal combustion engine.

3. A duct system according to claim 1, wherein said duct comprises a duct section having a venturi-form cross-sectional configuration, and wherein the throttle valve is arranged in the narrowest part of the venturi-form cross section.

4. A duct system according to claim 3, wherein said duct section is a venturi air intake nozzle.

5. A duct system according claim 1, wherein the throttle valve is arranged in an air inlet of an air intake duct of an internal combustion engine.

6. A throttle valve for installation in duct so as to be pivotable between a closed position and a fully open position, said duct having a cross-section, and said throttle valve in the closed position leaving a portion of the duct cross-section open so that fluid can flow therethrough, said portion of the duct cross-section annularly surrounding the throttle valve and having a cross-sectional area which amounts to between 10 and 40% of the overall cross-sectional area of the duct cross-section.

7. A process for controlling a throttle valve disposed in an air intake duct for an internal combustion engine, said duct having a cross-section, and said valve being movable between a fully open position and a closed position in which a residual portion of the duct cross-section remains open, said residual portion of the duct cross-section annularly surrounding the throttle valve and having a cross-sectional area which amounts to between 10 and 40% of the overall cross-sectional area of the duct cross-section, said process comprising adjusting the position of said valve in dependence on the amount of combustion air required by the internal combustion engine.

8. A process according to claim 6, wherein the position of the valve is adjusted in response to the rotational speed of the internal combustion engine.

9. A process according to claim 7, wherein in a selected operating state of the internal combustion engine, the position of the valve is adjusted to provide an opening larger than necessary to provide a minimum supply of combustion air to the internal combustion engine, and an acoustic feedback is thereby provided to an operator of the internal combustion engine.

* * * * *